United States Patent [19]

Benedick

[11] 4,252,070

[45] Feb. 24, 1981

[54] DOUBLE VALVE ANTI-LEAK SYSTEM FOR THERMAL REGENERATION INCINERATORS

[75] Inventor: Edward H. Benedick, Morristown, N.J.

[73] Assignee: Regenerative Environmental Equipment Co., Inc., Morris Plains, N.J.

[21] Appl. No.: 52,670

[22] Filed: Jun. 27, 1979

[51] Int. Cl.[3] ..... F23B 5/00; F23C 9/00; F23G 7/06

[52] U.S. Cl. ..... 110/211; 422/168; 422/175; 431/5

[58] Field of Search ..... 110/210, 211; 422/168, 422/175, 176, 178, 169; 431/5

[56] References Cited

U.S. PATENT DOCUMENTS

| | | | |
|---|---|---|---|
| 3,870,474 | 3/1975 | Houston | 422/178 X |
| 3,895,918 | 7/1975 | Mueller | 422/176 X |
| 4,018,568 | 4/1977 | Brewer | 110/210 X |
| 4,036,576 | 7/1977 | McCracken | 431/5 |
| 4,124,696 | 11/1978 | Kunkel | 422/169 X |
| 4,144,014 | 3/1979 | Hartwig | 431/5 |

FOREIGN PATENT DOCUMENTS

| | | | |
|---|---|---|---|
| 2452418 | 8/1975 | Fed. Rep. of Germany | 110/210 |

*Primary Examiner*—Edward G. Favors
*Attorney, Agent, or Firm*—Nelson E. Kimmelman

[57] ABSTRACT

In a system for purifying effluents from industrial processes in which there are a plurality of sections containing heat-exchange beds communicating with a high temperature incineration zone, the flow of effluent through the beds and the direction of flow being controlled by inlet and outlet valves associated with each section, double valves in series are provided at the inlet and/or outlet to each section to reduce leakage of the effluents past them when in a nominally closed position so as to prevent release of noxious gases into the ambient air. Additionally, purified heated gas from the incinerator may be fed under pressure between the valves of each set to suppress the flow of noxious effluent past any of the valves when they are supposed to be closed.

8 Claims, 2 Drawing Figures

DOUBLE VALVE ANTI-LEAK SYSTEM FOR THERMAL REGENERATION INCINERATORS

BACKGROUND OF THE INVENTION

1. FIELD OF THE INVENTION

This invention relates to anti-pollution apparatus and in particular to thermal regeneration incineration systems which can meet increasingly stringent anti-pollution requirements.

2. PRIOR ART

Thermal regeneration equipment is known which comprises a plurality of heat-exchange beds or chambers in communication with a high-temperature oxidation zone such as is shown in U.S. Pat. No. 3,895,918 to James H. Mueller. In such equipment, the exhaust gas or effluent from a factory, for example, is purified by passing it through a first inlet bed into the high temperature zone where noxious or toxic components are oxidized to decomposition. These oxidized gases are drawn by an exhaust fan from the high temperature chamber through a second heat-exchange bed to exhaust into the atmosphere. The elements of the second bed have their temperature raised substantially by the hot decomposed gases passing through them.

In apparatus such as shown in the Mueller patent, the same beds may function in different ways in different cycles of operation, i.e., in one cycle a particular bed may function as an inlet bed to which the effluent is initially applied and in another cycle as an outlet bed to which the heat-decomposed effluent combustion products are passed. Control of the mode of the beds is accomplished by providing an inlet valve and an outlet valve for each of the sections containing the beds.

Because of the very high temperatures involved in such apparatus, most such valves are metal-to-metal. For various reasons, the seal afforded by these valves when in the nominally "closed" condition, may be less than perfect with the result that between cycles of operation, for example, the effluent from the factory may leak past the valves directly into the exhaust duct and out through the stack. In many cases, such leakage is not very significant, but when the effluent has highly toxic or corrosive components, even the slightest amount of leakage into the ambient atmosphere may pose dangers to people and property and provoke action by the authorities for breach of anti-pollution laws. If the effluent leaks so that it effectively by-passes the combustion chamber, the overall thermal efficiency of the system is affected adversely. Such leakage may also damage the valves and other components of the apparatus.

It is therefore among the objects of the present invention to provide a system for reducing or preventing leakage of gases in the system past nominally closed valves.

It is also among the objects of the present invention to provide apparatus for reducing pollution especially in thermal regeneration incineration systems.

Still another object of the invention is to provide thermal regeneration incineration apparatus with improved thermal efficiency.

SUMMARY OF THE INVENTION

Sets of two (series) valves are provided in the inlets and/or outlets of incineration systems using thermal regeneration principles. In another form, pressurized and purified exhaust gases from the incinerator are recycled to the spaces between the two valves of each set.

DETAILED DESCRIPTION OF THE DRAWINGS

Figure 1:
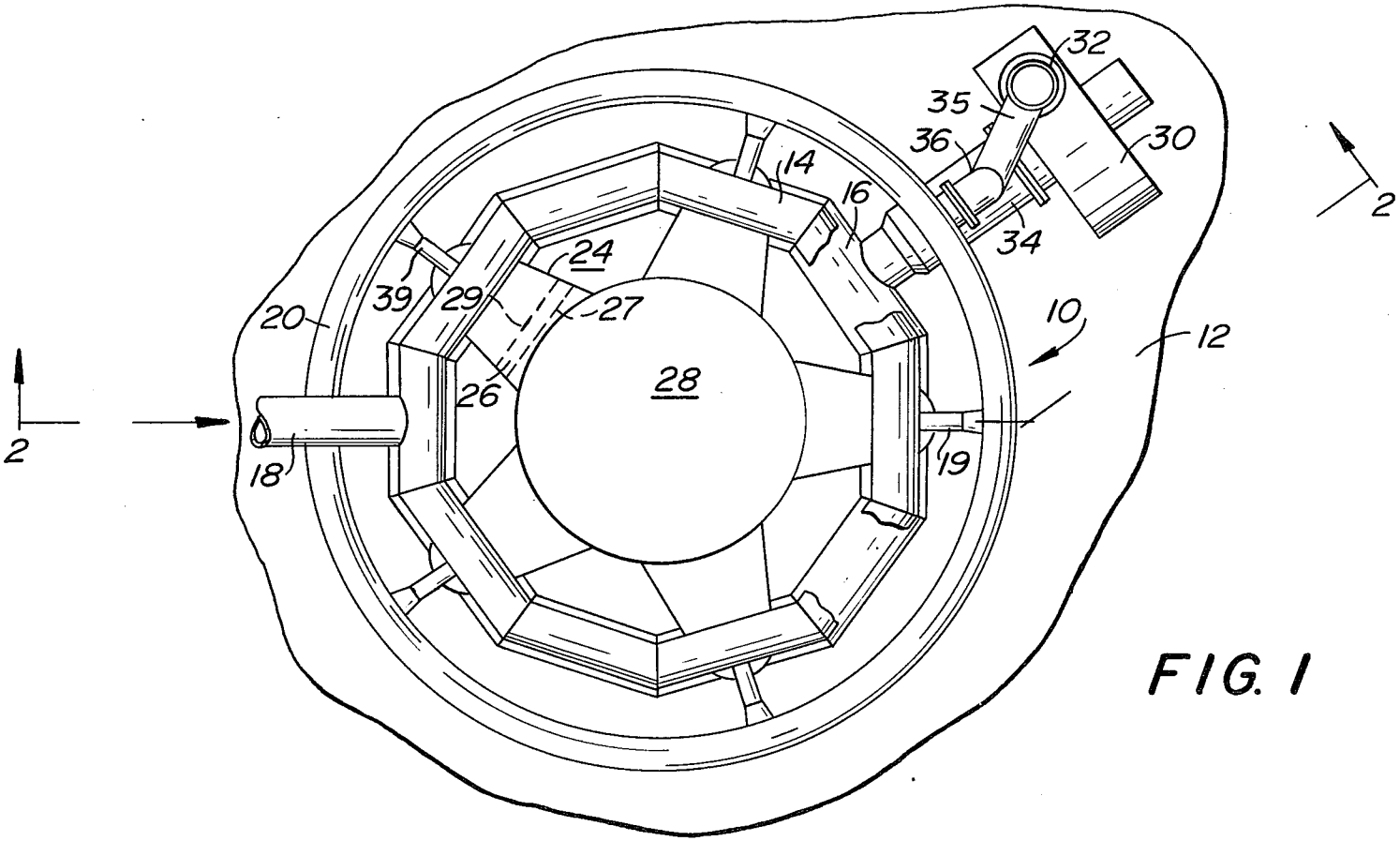
FIG. 1 is a plan view of a preferred form of the present invention.
Figure 2:
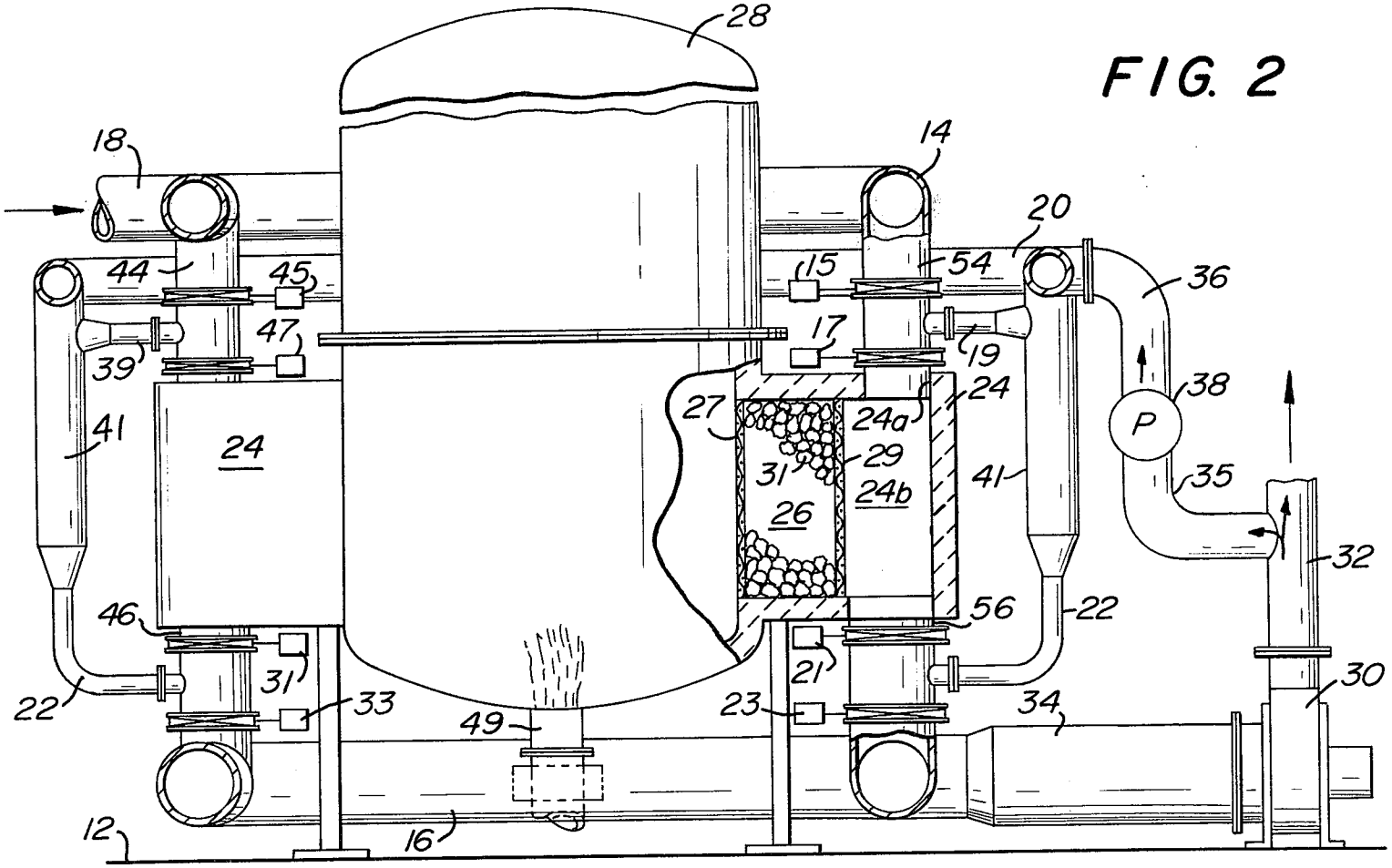
FIG. 2 is a sectional view of the apparatus shown in FIG. 1 taken along section line 2—2 in the direction indicated in FIG. 1.

Referring now to FIGS. 1 and 2 there is shown apparatus embodying the present invention at the numeral 10. Conventionally, effluent from an industrial process is conducted by an inlet duct 18 to an upper duct ring 14 that in turn has a plurality of vertical ducts 44 communicating with all of the sections 24 which respectively include a heat-exchange bed 26. It should be understood that all of the sections 24 are constructed alike, but only two are depicted to illustrate the path in a typical cycle of operation. Bed 26 is comprised of a plurality of ceramic elements 31 which may be, for example, saddle-shaped ("stones") confined by a front apertured wall 27 and a rear apertured wall 29. The vertical ducts 44 communicate with the space **24*b* outwardly of the retaining wall 29**.

On the inlet cycle, the effluent is fed to the left illustrated section 24 via a single inlet valve into the space **24*b*. At this time a single inlet valve 15 on the right side will be closed as will the left outlet valve 31 whereas the single outlet valve 21 on the right will be open. All of the outlet valves are in communication with the exhaust duct ring 16 that is connected by duct 34 to an exhaust fan 30 which has an output to stack 32. The fan 30 creates a suction in exhaust ring 16 and its vertical feeder ducts such as 46 and 56 so that the effluent proceeds downward through inlet duct 44 then toward the right through the heat-exchange bed 26. The latter has been warmed by the heat generated within the central combustion or oxidation chamber 28 that has been maintained at a very high temperature such as 1400°–1500° F. by the flame produced by burner 49 at its bottom. The heat within the central chamber 28 heats up the stones in all the beds 26 so that the left bed 26 pre-warms the effluent as it moves from left to right through it. The effluent is drawn through the chamber 28 so it is raised to a very high temperature in the central chamber 28 which decomposes the remaining pollutants. It is then sucked through the stones of the right-hand heat-exchange bed 26. The right heat-exchange bed is considerably cooler than the purified effluent by virtue of having been traversed by an incoming effluent in a previous cycle so that the hot, newly purified effluent gives up much of the heat imparted to it in the central chamber to the right bed. After passing through the right-hand bed 26, it arrives in the space 24*b*** cooled down to the 400° F.–500° F. range, for example.

This cooled, purified effluent then is drawn out of space **24*b* via conduit 56 into the exhaust ring 16 and then out of the system by exhaust fan 30**.

During the next cycle of operation, for example, the incoming effluent from the industrial process might be fed into the system via conduit 18, ring 14, conduit 54 and via a single (open) inlet valve 15 into the space **24*b* on the right side. In that next cycle, the single exhaust valve on the right would be closed whereas on the left the single inlet valve would be closed and the single outlet valve would be open. However, in the interim between cycles some unpurified effluent may be trapped in the space 24***b* on the left side so that when the left exhaust valve is opened at the beginning of the next cycle the residual effluent is sucked out without having been purified. In the case of toxic gases such as vinyl chloride this can cause damage to property and injury to humans. Even if the valves are supposed to be fully closed it is possible that the negative pressure produced by the exhaust fan 30 in exhaust ring 16 and conduit 46 would suck some of the effluent through a single inlet valve on the left into left section 24*b* and out through the single exhaust valve on that side. Such leakage could be due, for example, to imperfect sealing of the valves which may have been damaged by the high temperatures of the gases flowing through them. Since such valves are usually metal-to-metal, the valve seating may not be as tight as can be obtained with more compressible elements. This may enable the emission of noxious or highly toxic gases into the atmosphere.

In accordance with the present invention, the inlet and exhaust valves are used in sets of two as, for example, 45, 47 and 31, 33 on the left and 15, 17 and 21, 23 on the right. By providing two valves in series, much of the leakage is prevented. This is because the provision of two such valves in series produces a double pressure drop across them so that there is a lessened negative pressure produced by the exhaust fan 30 in the vertical inlet ducts 44 and 54 and in the vertical exhaust ducts 46 and 56. Consequently, there is a lesser probability of harmful amounts of noxious gases being drawn directly into the exhaust ring 16.

In accordance with a further feature of the invention, such leakage is further minimized by recycling some of the cooled, purified effluent from the exhaust ring back into the space between each set of two valves. Accordingly, if it is desired to recycle the purified effluent from the discharge side of the exhaust fan 30 rather than from the input to the fan, a pump 38 is provided which communicates by way of elbow 35 with the stack 32 and by way of duct 36 to another duct ring 20. Ring 20, for example, has horizontal duct connections 39 and 19 to the respective spaces between sets of inlet valves 45, 47 and 15, 17 respectively. The connections supply cooled pressurized and purified exhaust gas into those spaces thereby tending to repel any inlet effluent that may otherwise have gotten past the inlet valves 45 and 15 when they should be closed. Similarly, if both inlet valves 45 and 47 are supposed to be closed and there is some residual effluent in space 24*b* on the left, it cannot escape upward past the theoretically closed valve 47 because of the higher pressure of the purified gas in the space between those two inlet valves. If the right side is functioning in an outlet mode, the pressurized gas applied via feeder duct 19 prevents any inlet gas from escaping downward past inlet valve 15 when it is supposed to be closed and also prevents any upward movement of any gas through valve 17 when it is supposed to be closed.

The pressurized and purified exhaust gas is also transferred from the duct ring 20 via vertical ducts 41 and elbows 22 to the spaces between the exhaust ducts 31, 33 on the left and 21, 23 on the right. By so doing, when the left section 24 is in the inlet mode the recycled exhaust will tend to prevent any unpurified effluent in the spaces 24*b* from being sucked downward into the exhaust ring 16. When the right-hand section 24 is functioning in the exhaust mode, the valves 21 and 23 are open so the purified gas serves no sealing function in the space between them. When the right section 24 is changed to operate in the inlet mode those valves 21 and 23 are both closed and sealed by the introduction of purified exhaust between them.

By the use of one or both of the two features explained above, the amount of valve leakage is significantly reduced or even completely stopped so that pollution is minimized or prevented. If the effluent is highly toxic, such as vinyl-chloride, damage to persons may be avoided by compliance with the most stringent anti-pollution regulations. Furthermore the use of these features helps to maintain the thermal efficiency of the overall system.

I claim:

1. Incineration Apparatus comprising (a) a plurality of heat-exchange sections each having a plurality of heat-exchange elements, (b) a plurality of inlets respectively associated with said sections for carrying to said sections gaseous effluents to be oxidized, (c) a plurality of outlets respectively associated with said sections for removing purified gaseous combustion products therefrom, (d) a high-temperature oxidation chamber in communication with each of said sections, and (e) a predetermined number of sets of valve means, each set including two valves spaced from one another and disposed in series in predetermined ones of said inlets and outlets, each of said sets operating to minimize passage of gas through them when they are nominally closed.

2. The incineration apparatus according to claim 1 wherein all of said inlets and outlets are provided with respective sets of valves.

3. The incineration apparatus according to claims 1 or 2 wherein means are provided to supply non-noxious gas under pressure to the spaces between the valves of predetermined ones of said sets.

4. The incineration apparatus according to claims 1 or 2 wherein all of said outlets are coupled to a common exhaust and wherein a part of the gases in said exhaust are recycled to the spaces between the valves of predetermined ones of said sets.

5. The incineration apparatus according to claim 3 wherein each of said sections includes a first chamber outwardly of said heat-exchange bed to which one inlet and one outlet are coupled and further includes an inlet duct ring to which each inlet is coupled and further includes an outlet duct ring to which each outlet is coupled, the couplings of the inlets and outlets to the inlet and outlet rings respectively supplying said pressurized gas to the spaces between the valves of said sets.

6. The incineration apparatus according to claims 1 or 2 wherein means are provided coupled to a selected one or ones of said (c) means for supplying said purified gaseous combustion products to the spaces between the valves of a predetermined one or ones of said sets.

7. The incineration apparatus according to claim 6 wherein the pressure of said purified gaseous combustion products supplied to said spaces is selected to be higher than the pressure of other gases in said spaces.

8. The incineration apparatus according to claim 1 wherein exhaust means are provided coupled to said (c) means for collecting said purified gaseous combustion products, said exhaust means also including exhaust fan means to which said collected combustion products are applied, and wherein means are provided to supply at least a portion of said applied combustion products to the spaces between the valves of a predetermined one or ones of said sets.

* * * * *